US010745896B2

(12) United States Patent
Ye et al.

(10) Patent No.: US 10,745,896 B2
(45) Date of Patent: Aug. 18, 2020

(54) SHOWER CONTROLLING DEVICE AND SHOWER DEVICE

(71) Applicants: Xiamen Lota International Co., LTd., Xiamen, Fujian (CN); La Vida Industrial Co., Ltd., Xiamen, Fujian (CN)

(72) Inventors: Liming Ye, Fujian (CN); Jianping Zhou, Fujian (CN); Shuanglin Bai, Fujian (CN); Lucheng Wang, Fujian (CN)

(73) Assignees: Xiamen Lota International Co., LTd., Xiamen (CN); La Vida Industrial Co., Ltd., Xiamen (CN)

( * ) Notice: Subject to any disclaimer, the term of this patent is extended or adjusted under 35 U.S.C. 154(b) by 274 days.

(21) Appl. No.: 15/884,754

(22) Filed: Jan. 31, 2018

(65) Prior Publication Data

US 2018/0313066 A1 Nov. 1, 2018

(30) Foreign Application Priority Data

Apr. 26, 2017 (CN) ..... 2017 1 0284731

(51) Int. Cl.
*F16K 43/00* (2006.01)
*E03C 1/04* (2006.01)
*E03C 1/042* (2006.01)

(52) U.S. Cl.
CPC ..... *E03C 1/0409* (2013.01); *E03C 1/0408* (2013.01); *E03C 1/042* (2013.01); *E03C 1/0412* (2013.01)

(58) Field of Classification Search
CPC ..... E03C 1/023; E03C 1/0409; E03C 1/041; E03C 2201/50
See application file for complete search history.

(56) References Cited

U.S. PATENT DOCUMENTS 2,519,158 A * 8/1950 Symmons ..... F16K 11/0565 137/597
4,095,610 A * 6/1978 Priesmeyer ..... E03C 1/0408 137/100
6,453,943 B1 * 9/2002 Chang ..... E03C 1/023 137/597
6,973,937 B1 * 12/2005 Yang ..... E03C 1/023 137/119.05
7,077,150 B2 * 7/2006 McNerney ..... E03C 1/042 137/15.01
8,312,897 B2 * 11/2012 Niver ..... E03C 1/023 137/119.05

* cited by examiner

*Primary Examiner* — Reinaldo Sanchez-Medina
(74) *Attorney, Agent, or Firm* — Zhong Law, LLC

(57) ABSTRACT

The present disclosure relates to a shower device and a shower controlling device. The shower controlling device comprises: a tube structure having a first inlet tube, a second inlet tube and an outlet tube; a mixing valve having mixing chamber which is in fluid communication with the outlet tube and is maintained to be in fluid communication with at least one of the first inlet tube and second inlet tube; a switching valve which is spaced apart from the mixing valve and is suitable for controlling the switching on/off of the outlet tube; a mounting disc provided to be spaced apart from the tube structure; and a transferring and adjusting mechanism which is mounted between the switching valve and the mounting disc in such a manner that the length of the mechanism is adjustable, and is able to operate the switching valve under an external force.

11 Claims, 16 Drawing Sheets

SHOWER CONTROLLING DEVICE AND SHOWER DEVICE

CROSS-REFERENCE TO RELATED APPLICATIONS

This application claims foreign priority to China Patent Application No. CN 201710284731.7 filed Apr. 26, 2017, the content of which is incorporated herein by reference in its entirety.

TECHNICAL FIELD

The present disclosure relates to the technical field of bath devices, and in particular, to shower controlling devices and shower devices.

BACKGROUND

Usually, a shower device is provided with a mixing and switching valve incorporating both functions of temperature adjusting and water flow switching for the control of the temperature and the switching on/off of the water flow. In many cases, such valve is embedded in the wall along with water tubes, only exposing the components for operation such as handle. Users may operates (e.g. rotates or pulls/pushes) the handle coupled with the mixing and switching valve to switch on/off the water supply and adjust the temperature of the water. In some situations, the user may hope to only cut off the water supply without changing the temperature of water. However, more or less, the mixing and switching valve will affect the water temperature during operation, and thus the user has to readjust the temperature again, which is inconvenient. In addition, many valves cannot be adapted to different installing depths in walls during installation, resulting in a limitation to their installation.

SUMMARY OF THE DISCLOSURE

Therefore, there is a need for a shower device which is more comfortable for usage and has a better adaptability for installation.

It is an object of the present disclosure to provide a shower controlling device that can at least partially address the above mentioned problems.

It is another object of the present disclosure to provide a shower device with such improved shower controlling device.

According to an aspect of the disclosure, a shower controlling device is provided, comprising: a tube structure having a first inlet tube, a second inlet tube and an outlet tube; a mixing valve having a mixing chamber which is in fluid communication with the outlet tube and is maintained to be in fluid communication with at least one of the first inlet tube and second inlet tube; a switching valve which is spaced apart from the mixing valve and is suitable for controlling the switching on/off of the outlet tube; a mounting disc provided to be spaced apart from the tube structure; and a transferring and adjusting mechanism which is mounted between the switching valve and the mounting disc in such a manner that the length of the mechanism is adjustable, and is able to operate the switching valve under an external force.

In this shower controlling device, the temperature and the flow rate are controlled independently. The switching valve only controls the flow rate and the switching on/off of the flow, while the mixing valve only controls the temperature. After setting the temperature, the user does not need to adjust it again, and only needs to switch on the closed switching valve, which makes the use of this device convenient, fast and efficient. The transferring and adjusting mechanism allows for the fast installation of the shower controlling device according to different mounting depths in walls, and is able to transfer the function of the operation portion to the outside of the wall while withstanding the strong force generated by the mounting, fixation, using and operation.

In an embodiment, the shower controlling device further comprises a panel member which comprises: a body covering the mounting disc; a button accommodated within a hole of the body and abutted against the transferring and adjusting mechanism; and a spring provided between the body and the button and configured to exert a force on the button towards the transferring and adjusting mechanism. Accordingly, the button can transfer the force following the transferring and adjusting mechanism in the mounting disc, and the switching on/off state of the switching valve can be visually confirmed.

The tube structure, the mixing valve and the switching valve constitute a first preassembly, while the mounting disc and the transferring and adjusting mechanism constitute a second preassembly, and the panel member constitutes a third preassembly. The three preassemblies form modular mounting structures, resulting in a simple and fast operation.

In an embodiment, the transferring and adjusting mechanism is configured to be able to press the switching valve to an extreme state under the external force. The "extreme state" means a state in which the spool of the switching valve moves to the terminal point under pressing. In the switching valve according to an embodiment of the disclosure, if the spring spool is pressed to an extreme state, it may slightly bounce when the pressing force is withdrawn. That is, the switching valve includes a switching on state, a switching off state and an extreme state.

In an embodiment, the transferring and adjusting mechanism comprises: an adjusting sleeve axially movably supported on the mounting disc; and an adjusting stem axially movably provided in the adjusting sleeve and adapted to press the switching valve, wherein the adjusting stem is configured to move away from the switching valve together with the adjusting sleeve after the disappearance of the external force.

The mounting disc includes a bore accommodating the transferring and adjusting mechanism, and between at least one of the two ends of the adjusting sleeve and the bore is formed an axial stopping structure defining the terminal of the axial movement of the adjusting sleeve. In this way, the adjusting sleeve may be prevented from coming out of the mounting disc.

The axial stopping structure comprises: a small protrusion formed on the outer peripheral surface of the adjusting sleeve; and a stopping end surface formed on the bore of the mounting disc.

The bore forms an axial groove bypassing the small protrusion and spaced apart from the stopping end surface.

The axial stopping structure comprises: an outer extending flange formed on the adjusting sleeve; and a stopping step formed on the bore, wherein the outer extending flange can sit on the stopping step.

In an embodiment, the shower controlling device further comprises a limiter that can be detachably coupled to the mounting disc to limit the movement of the transferring and adjusting mechanism away from the switching valve. The limiter is used to temporally limit the movement of the transferring and adjusting mechanism during the installation, to ensure the accuracy of the relative position between the transferring and adjusting mechanism and the switching valve. After the completion of the installation, the limiter is detached from the mounting disc to allow for the normal functionality of the shower controlling device.

The limiter includes a first protrusion and a first recess which are peripherally adjacent to each other, the bore of the mounting disc accommodating the transferring and adjusting mechanism includes a second recess corresponding to the first protrusion and a second protrusion corresponding to the first recess, and on the second protrusion is formed a peripheral sliding groove in which the first protrusion slides and which includes an open end and a closed end; or the dimensions of the limiter is configured to form an interference fit with the bore of the mounting disc.

According to another aspect of the present disclosure, a shower device is provided, comprising: the aforesaid shower controlling device; and a sprayer in fluid communication with the outlet tube of the tube structure of the shower controlling device.

A part of other features and advantages of the present disclosure will be apparent to the skilled person in the art after reading the disclosure, while the other part will be described in the following specific embodiment in combination with the drawings.

BRIEF DESCRIPTION OF DRAWINGS

Hereinafter, the embodiments of the present disclosure will be described in detail in combination with drawings wherein.

In this disclosure, identical or similar reference numerals represent identical or similar features.

LIST OF REFERENCE NUMERALS

Figure 1:
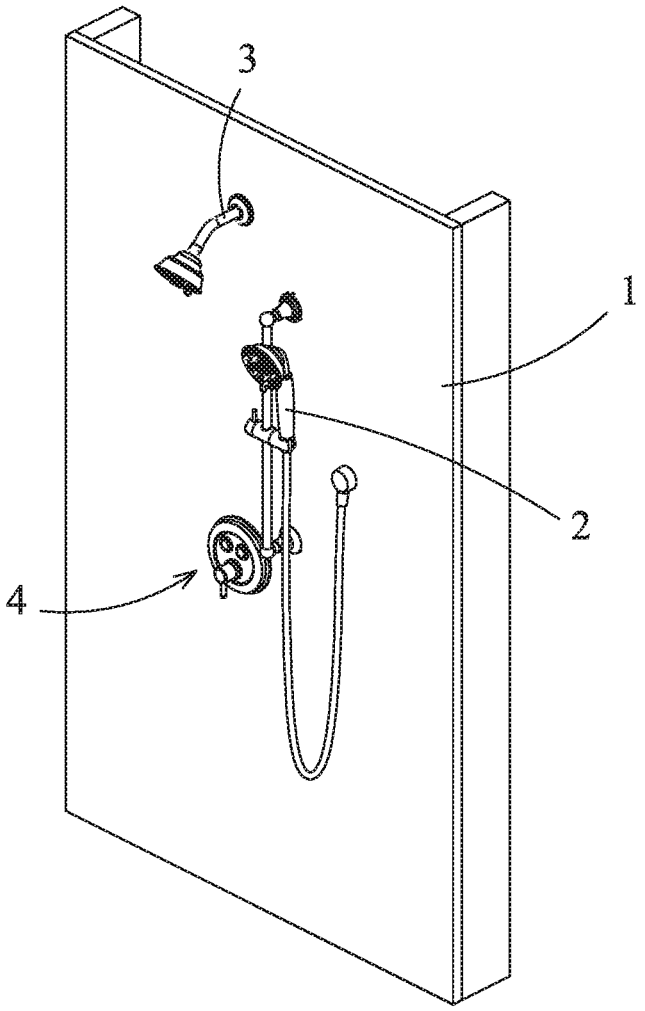
FIG. 1 is a schematic view of the shower device installed on the wall according to an embodiment of the disclosure.

1—wall
2—movable sprayer
3—fixed sprayer
4—shower controlling device
40—tube structure
401—first inlet tube
402—second inlet tube
403—first outlet tube
404—second outlet tube
405—first mounting seat
4050—inlet port
4051—outlet port
406—second mounting seat
407—third mounting seat
408—fourth mounting seat
409—fifth mounting seat
41—mixing valve

412—valve spindle
413—pressure balancing mechanism
42—switching valve
421—spring spool
422—diaphragm
423—valve seat
43—mounting disc
431—bore
4311—stopping end surface
432—blind hole
433—aperture
434—screw nut
435—axial groove
436—stopping step
437—second recess
438—second protrusion
439—peripheral sliding groove
44—transferring and adjusting mechanism
441—adjusting sleeve
442—adjusting stem
443—limiter
444—retraction stopping member
445—screw
446—small protrusion
447—outer extending flange
448—first protrusion
449—first recess
45—panel member
451—body
452—button
4521—spring
453—snap ring
454—first hole
455—second hole
456—annular wall
4561—outer peripheral wall
4562—inner peripheral wall
4563—annular groove
4564—inner extending flange
457—cylinder portion
458—cover portion
4581—overhanging section
459—third hole
46—protection cover
47—one-way stopping valve
48—handle
481—shim

DETAILED DESCRIPTION

Now the schematic solutions of the shower controlling device and the shower device disclosed by the present disclosure will be described in detail. Although some drawings are provided to illustrate some embodiments of the present disclosure, these drawings may not necessarily be depicted in scale, and some features may be enlarged, removed or cut off in part to show and explain the present disclosure better. The positions of some elements in the drawings may be adjusted as desired without influencing the technical effect. The phrase "in the drawings" or the like as used in the description may not refer to all the drawings or examples.

Some orientation terms, e.g. "inner", "outer", "upper", "lower" and other orientation terms, as used hereinafter for describe the drawings will be understood as having their normal meanings and indicating those directions as involved when the drawings are viewed normally. Basically, the orientation terms as stated in the present specification will be interpreted according to the routine directions as understood by the skilled person in the art, unless otherwise specified.

The terms "first", "the first", "second", "the second" and the like as used in the disclosure do not represent any order, amount or importance in this disclosure, but rather are used to differentiate one element from other elements.

Figure 2:
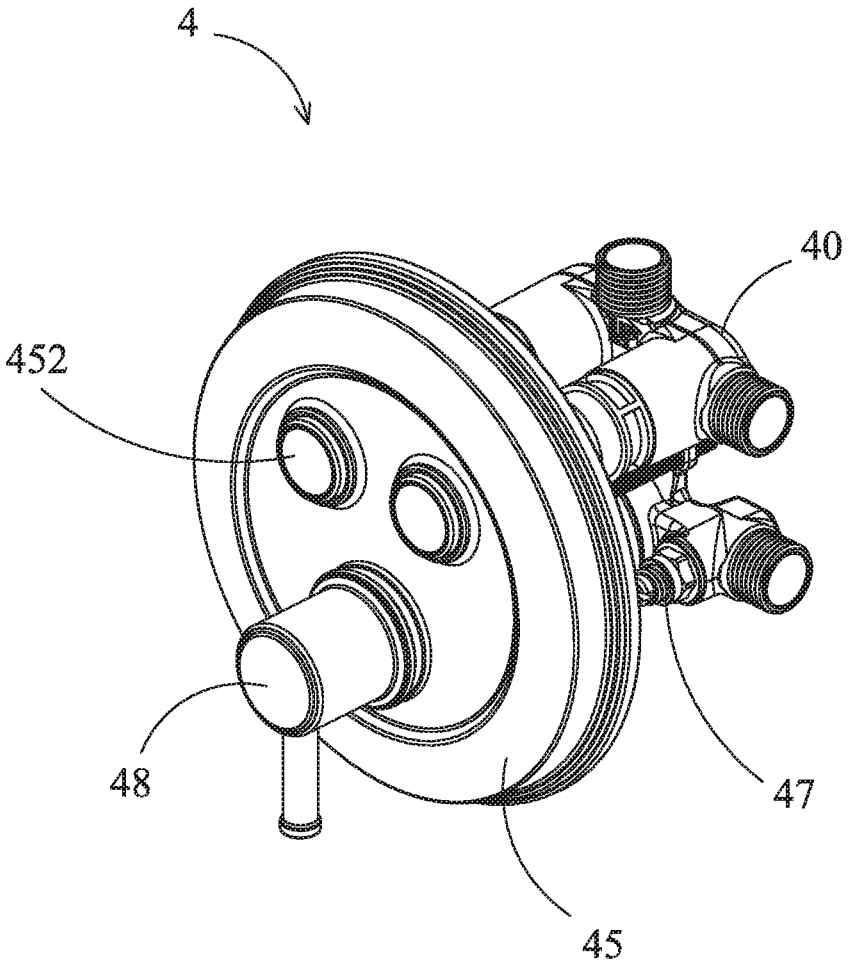
FIG. 2 is a schematic view of the shower controlling device after assembled according to an embodiment of the disclosure.
Figure 3:
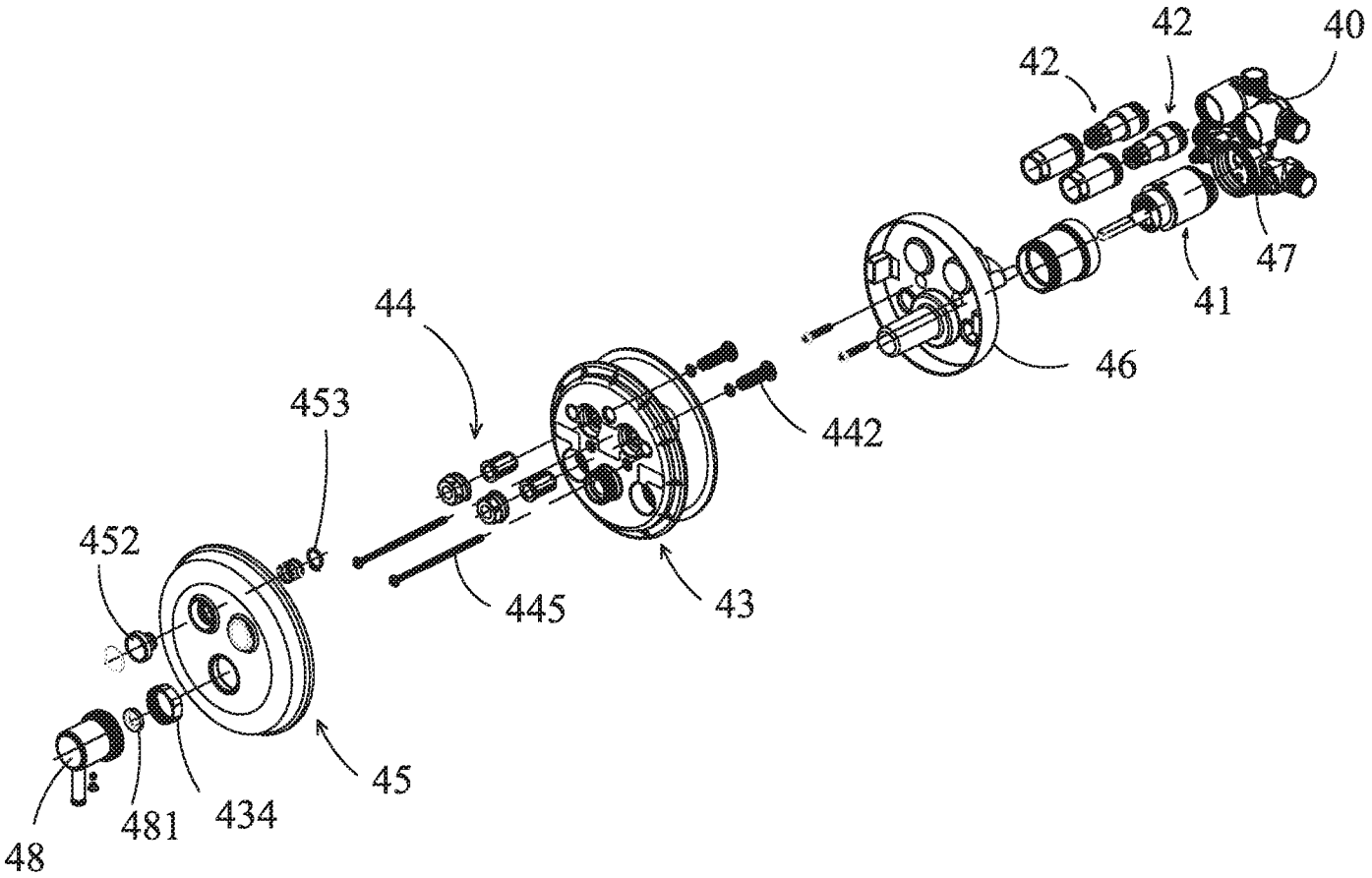
FIG. 3 is an exploded schematic view of the shower controlling device according to an embodiment of the disclosure.
Figure 4:
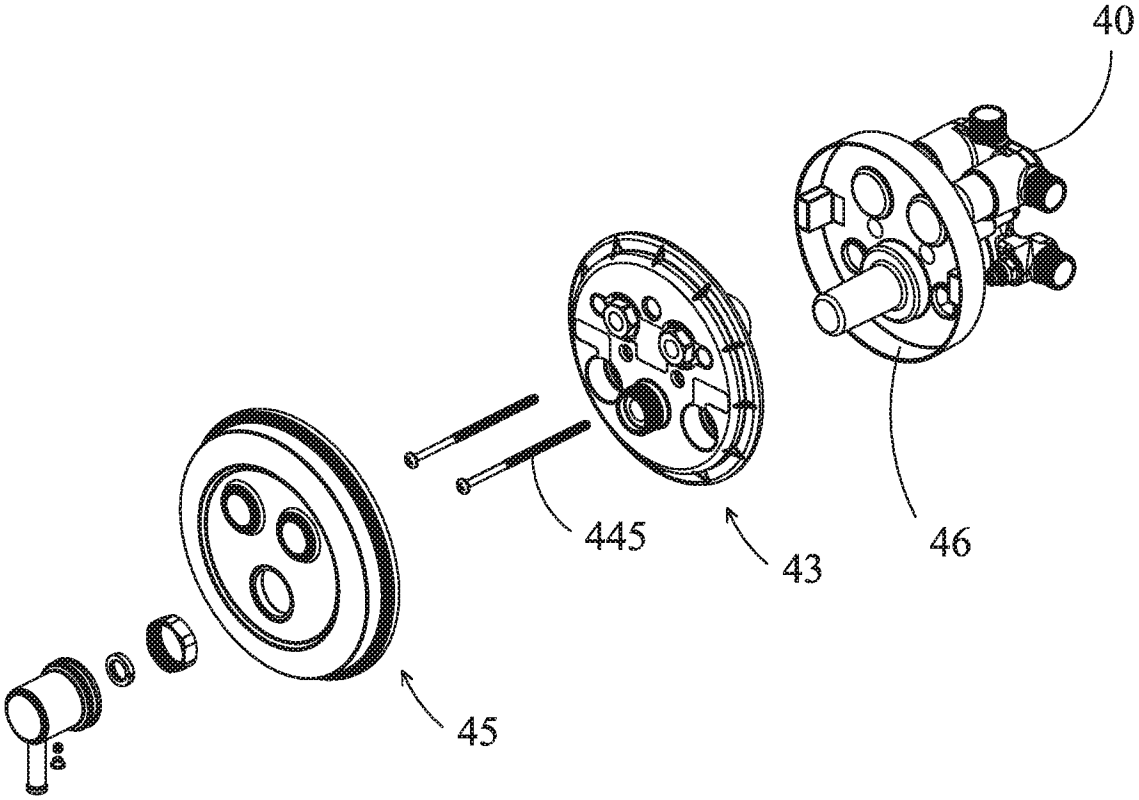
FIG. 4 is a schematic view of the various modular preassemblies of the shower controlling device according to an embodiment of the disclosure.
Figure 5:
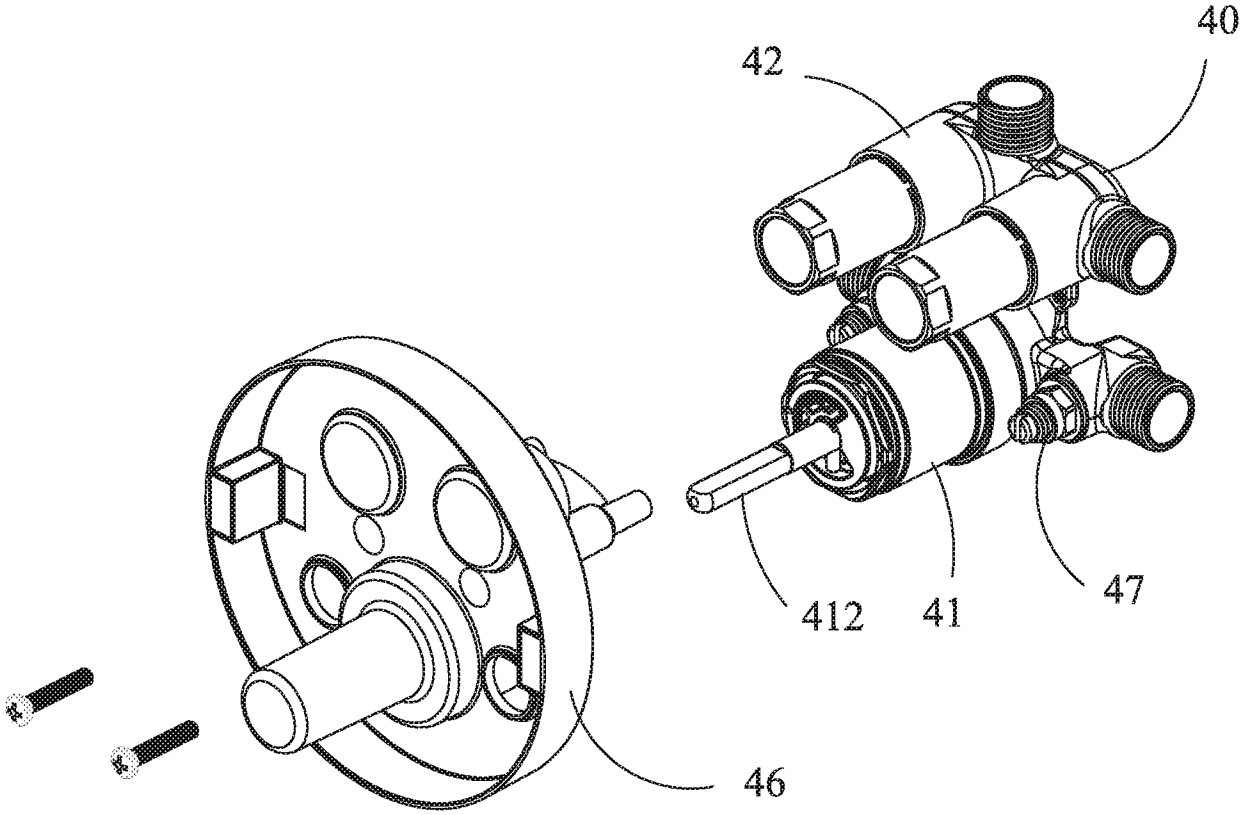
FIG. 5 is a schematic view of the first preassembly and the protection cover according to an embodiment of the disclosure.

FIG. 1 shows a schematic view of the shower device according to an embodiment of the present disclosure, with the shower device having been installed in the wall. As shown, the shower device comprises a shower controlling device 4 which is at least partially embedded in the wall 1, a fixed sprayer 3 and a movable sprayer 2 which are mounted on the wall 1 and operatively connected to the shower controlling device 4. FIGS. 2-4 schematically show an overall schematic view and exploded schematic views of the shower controlling device 4 according to the embodiment of the present disclosure. In the shown embodiment, the shower controlling device 4 comprises a tube structure 40, a mixing valve 41 and a switching valve 42 that are mounted on the tube structure 40, a mounting disc 43 sleeved on the mixing valve 41 and the switching valve 42, a transferring and adjusting mechanism 44 located between the switching valve 42 and the mounting disc 43, and a panel member 45 for covering the mounting disc 43. In addition, in order to protect the shower controlling device 4 in transport or storage, a protection cover 46 is provided on the switching valve 42 and the mixing valve 41 before installation. Referring to FIG. 4, before installing the shower controlling device 4 in the wall 1, the tube structure 40, mixing valve 41 and switching valve 42 may be assembled into a first preassembly and be protected by the protection cover 46, the mounting disc 43 and the transferring and adjusting mechanism 44 may be assembled into a second preassembly, and the panel member 45 may constitute a third preassembly, thereby forming a modular assembling structure. Referring to FIG. 5, during the assembling, the protection cover 46 is detached, and then the three preassemblies are connected in sequence. This operation is simple and fast.

Hereinafter, the shower controlling device 4 of the present disclosure will be described in detail in combination with FIGS. 6-27.

Figure 6:
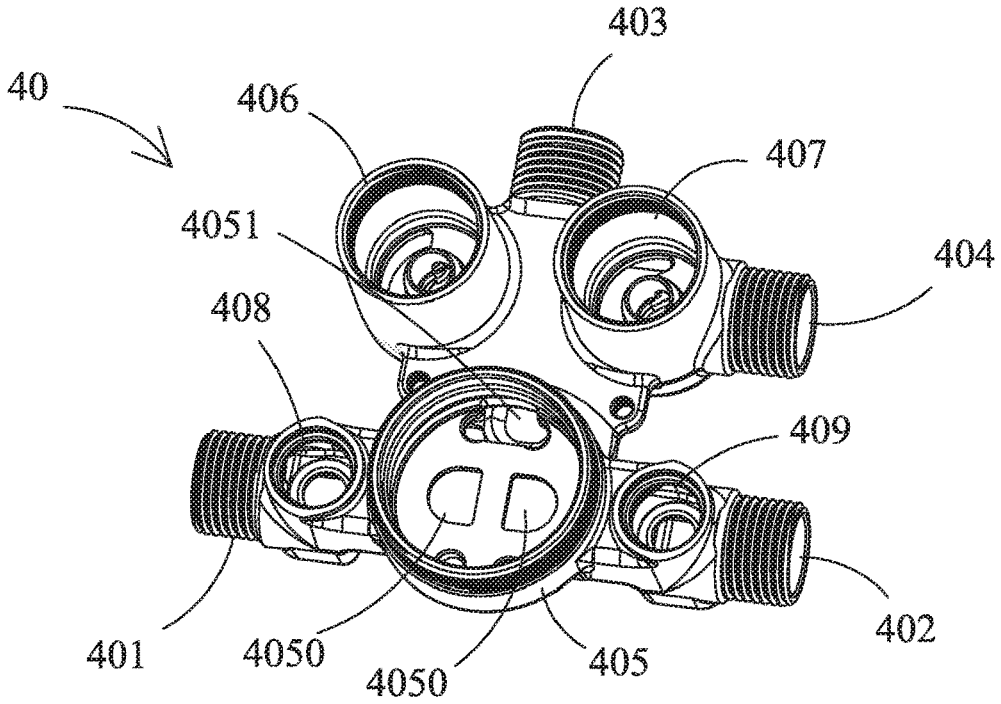
FIG. 6 is a schematic view of the tube structure according to an embodiment of the disclosure.

FIG. 6 schematically shows a schematic view of the tube structure 40 according an embodiment of the present disclosure. As shown, the tube structure 40 may for example be an integrally forged copper member, which is extraordinary advantageous in water routing, machinability, formability, function requirement and bearing strength. In the shown embodiments, the tube structure 40 includes a first inlet tube 401 used for introducing hot water, a second inlet tube 402 used for introducing cold water, and a first outlet tube 403 and a second outlet tube 404 that are used for guiding the mixed water to the aforesaid fixed sprayer 3 and the movable sprayer 2 respectively. Of course, for a shower device having only one sprayer, the tube structure 40 may include only one outlet tube accordingly. The mixing valve 41 is mounted within a first mounting seat 405 of the tube structure 40. The two switching valves 42 are respectively mounted within a second mounting seat 406 and a third mounting seat 407 of the tube structure 40 to control the switching on/off of the fluid in each outlet tube respectively, while two one-way stopping valves 47 are respectively mounted within a fourth mounting seat 408 and a fifth mounting seat 409 of the tube structure 40.

Figure 7:
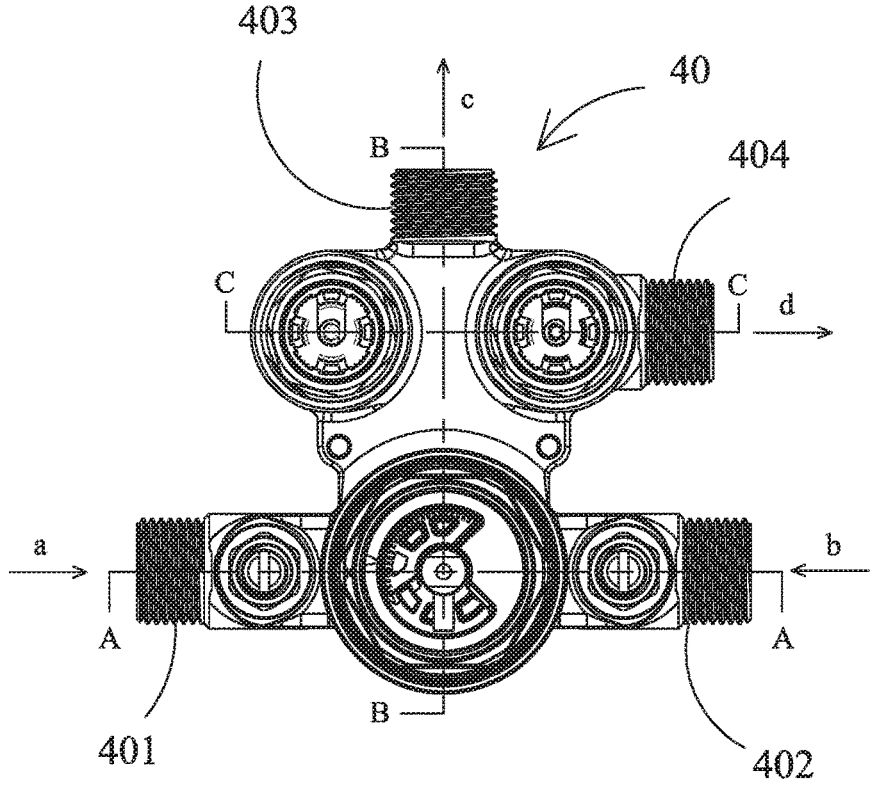
FIG. 7 is a plane view of the preassembly according to an embodiment of the disclosure.
Figure 8:
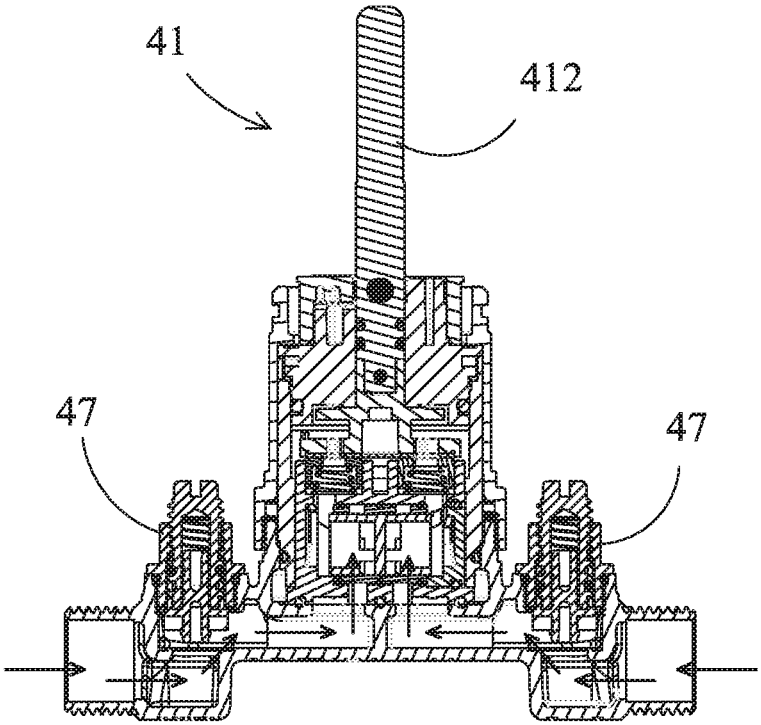
FIG. 8 is a section view taken along line A-A in FIG. 7.
Figure 9:
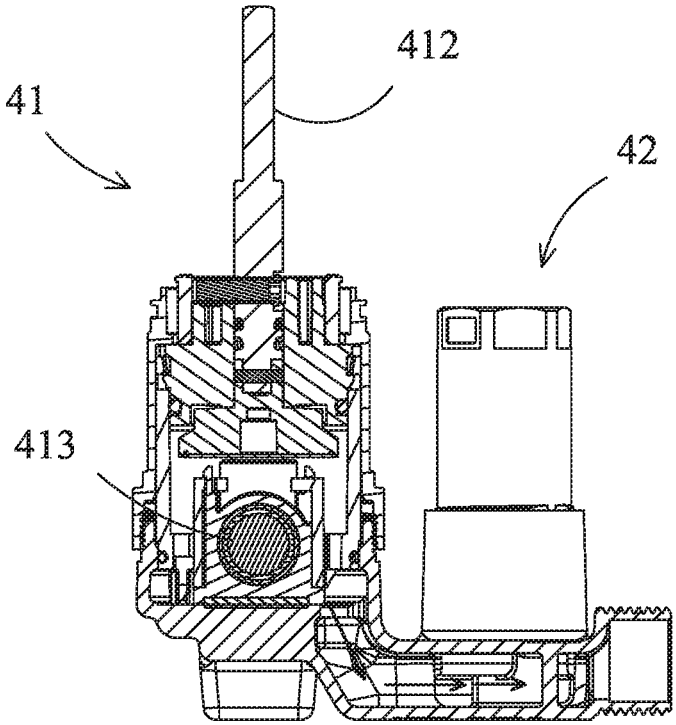
FIG. 9 is a section view taken along line B-B in FIG. 7.

FIGS. 7-10 show schematic views of the embodiment of the present disclosure, with the switching valves 42 and the mixing valve 41 having been mounted to the tube structure 40. As shown in FIGS. 7-9, in the shown embodiment, the mixing valve 41 (e.g., a pressure balancing valve) may have a sole function of water temperature regulation. Referring to FIG. 8, two types of fluid, such as cold water and hot water, flow from two inlet ports 4050 (see FIG. 6) of the first mounting seat 405 of the tube structure 40 into a mixing chamber of the mixing valve 41 through the first inlet tube 401 and the second inlet tube 402 in the direction of the arrows. Referring to FIG. 9, the mixed water flows from the mixing chamber of the mixing valve 41 into the first outlet tube 403 and the second outlet tube 404 through the outlet port 4051 (see FIG. 6) of the first mounting seat 405. In the shown embodiment, the mixing valve 41 includes a valve spindle 412 with a valve plate, and a pressure balancing mechanism 413. The cold water and the hot water flow, through the pressure balancing mechanism 413 respectively, into the mixing chamber for mixing. During the twisting of the valve spindle, the mixing chamber is always maintained to be fluidly connected with at least one of the first inlet tube 401 and the second inlet tube 402. That is, within the range of rotation of the valve spindle, at least one type of fluid can flow into the mixing chamber, to achieve the sole function of water temperature regulation of the mixing valve 41. This mixing valve has a temperature adjusting performance that is more sensitive than the conventional thermostatic valve, and is able to achieve accurate regulation and limitation of water temperature.

Figure 10:
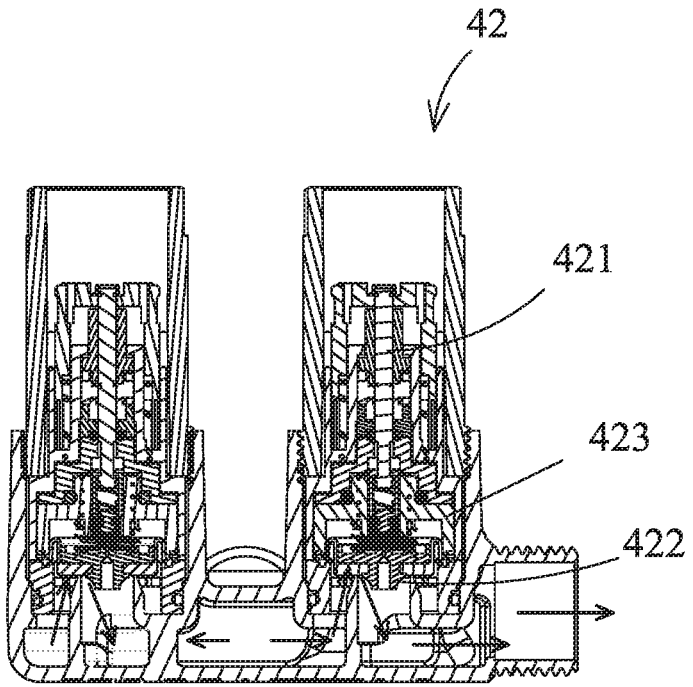
FIG. 10 is a section view taken along line C-C in FIG. 7.

As shown in FIG. 10, in the first outlet tube 403 and the second outlet tube 404, the mixed water flows through the respective switching valve 42 in the direction of the arrows and is controlled by the valve 42 for switching on/off. In the shown embodiment, the switching valve 42 includes a valve seat 423, a spring spool 421 and a diaphragm 422. In this case, the diaphragm 422 sits on the valve seat 423 and divides the valve chamber in the valve seat 423 into two portions, i.e. an upper portion and a lower portion. The lower portion is always maintained to be connected to the respective outlet tube of the tube structure 40. The diaphragm 422 includes a central through-hole and a lateral through-hole that is at a distance from the central through-hole. The lateral through-hole allows the upper and lower portions of the valve chamber to be always fluidly connected with each other, and the central through-hole selectively allows the upper and lower portions of the valve chamber to be fluidly connected or disconnected with each other under the control of the spring spool 421. The spring spool 421 works in a similar way as the spring cartridge of a ball pen. After pressing down the spring spool 421, the spring spool 421 automatically switches its state to block the central through-hole of the diaphragm 422 or to disengage from the central through-hole. When the spring spool 421 blocks the central through-hole, the mixed fluid flows into the upper portion of the valve chamber through the lateral through-hole and exerts pressure on the diaphragm 422, to allow the diaphragm 422 to securely abut against the valve seat 423, so as to cut off the connection of the mixed fluid. After pressing down the spring spool 421 again, the spring spool 421 automatically switches its state to disengage from the diaphragm 422, such that the upper and lower portions of the valve chamber is connected with each other and the upper portion of the valve chamber is released from pressure, and thus the diaphragm 422 does not abut against the valve seat 423 anymore. Instead, the diaphragm 422 is flushed away by the mixed fluid, such that the mixed fluid can flow out through the gap between the diaphragm 422 and the valve seat 423 and can be supplied to the sprayer.

The work division of the mixing valve 41 and the switching valves 42 can bring a better shower experience to the user. It is understood by the skilled person in the art that the structure of the mixing valve and the switching valves themselves is not crucial, and their structure and work principle may be already known and hence will not be described in detail herein. It is also understood by the skilled person in the art that although a specific form of the mixing valve and switching valves has been illustrated herein, it is conceivable that a variety of existing mixing valves, switching valves or other valves can be combined with the tube structure 40 or the like of the present disclosure to obtain the shower control device 4 according to the disclosure, which falls within the scope of this disclosure.

FIGS. 11-15 schematically show a schematic view of the second preassembly including the mounting disc 43 and the transferring and adjusting mechanism 44. As shown, the mounting disc 43 and the tube structure 40 are sleeved on the mixing valve 41 and the switching valve 42 and are spaced apart from each other, and the transferring and adjusting mechanism 44 is mounted between the mounting disc 43 and the switching valve 42, such that the shower controlling device 4 can be adapted to different installing depths in wall.

Figure 11:
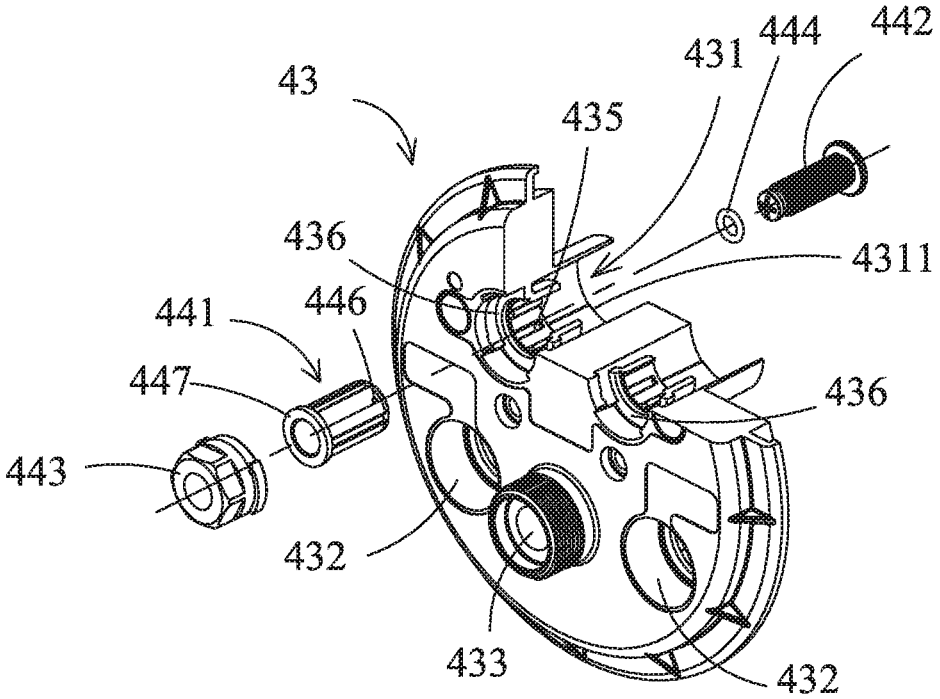
FIG. 11 is an exploded schematic view of the second preassembly according to an embodiment of the disclosure, with the mounting disc being partially cut.

In the shown embodiment, formed on the mounting disc 43 are a bore 431 for accommodating the transferring and adjusting mechanism 44 and an aperture 433 through which the valve spindle of the mixing valve 41 passes. The transferring and adjusting mechanism 44 is mounted between the switching valve 42 and the mounting disc 43 in such a way that the length of the mechanism is adjustable, and can operate the switching valve 42 under the effect of external force. Referring to FIG. 11, an exploded schematic view of the transferring and adjusting mechanism 44 according to an embodiment of the present disclosure is shown. As illustrated, the transferring and adjusting mechanism 44 comprises an adjusting sleeve 441 supported in the bore 431 in an axially movable manner and an adjusting stem 442 provided through the adjusting sleeve 441 in an axially movable manner. By adjusting the length by which the adjusting stem 442 extends over the adjusting sleeve 441, the adjusting stem 442 abuts against the switching valve 42, so that the shower controlling device 4 is adapted to different installing depths in wall. In the shown embodiment, the adjusting stem 442 and the adjusting sleeve 441 can achieve a stepless adjustment by means of threads. Preferably, a self-locking screw is adopted for the threads of the adjusting stem 442 and the adjusting sleeve 441 to further prevent loosing. In another embodiment which is not shown, the relative movement of the adjusting stem and the adjusting sleeve is realized by a ratchet, which is configured to allow the adjusting stem to move towards the direction of the switching valve in relative to the adjusting sleeve. Meanwhile, when the adjusting stem moves away from the switching valve, the ratchet allows the adjusting sleeve and the adjusting stem move together. That is, the movement of the adjusting stem is "irreversible". In another embodiment which is not shown, the adjusting sleeve has a certain degree of elasticity, while the diameter of the adjusting stem is variable along the axial direction. The variation of the diameter may be continuous, such that e.g. at least a portion of the adjusting stem is in a cone shape, or may be discontinuous, such that e.g. the adjusting stem includes a larger diameter portion and a smaller diameter portion which are spaced away from each other in the axial direction. After the larger end of the cone/the larger diameter portion is separated from the adjusting sleeve due to the movement of the adjusting stem, the adjusting sleeve automatically shrinks and tightly enwraps the adjusting stem because of its elasticity, so that the adjusting stem cannot move back into the adjusting sleeve in the opposite direction.

In order to prevent the adjusting sleeve 441 decouples from the mounting disc 43 during the movement, an axial stopping structure for delimiting the end-point of the axial movement of the adjusting sleeve 441 is formed between the bore 431 of the mounting disc 43 and the adjusting sleeve 441. As clearly shown in FIG. 11, a small protrusion 446 is formed at the outer periphery of the first end of the adjusting sleeve 441, while an axial groove 435 is formed on the inner wall of the bore 431 of the mounting disc 43. This axial groove 435 does not extend across all the inner wall of bore 431, but rather is spaced apart from the end surface 4311 (or referred as stopping end surface) of the bore 431 toward the switching valve 42. When the adjusting sleeve 441 moves within the bore 431, the small protrusion 446 is inserted into the axial groove 435 and moves along the groove. Once the adjusting sleeve 441 moves to such degree that the small protrusion 446 is separated from the bore 431, the small protrusion 445 is stopped by the stopping end surface 4311 and thus cannot move back into the axial groove 435. As such, when the adjusting sleeve 441 moves in a direction away from the switching valve 42, the small protrusion 446 and the stopping end surface 4311 of the bore 431 cooperate to delimit the end point of the movement of the adjusting sleeve 441 in such direction.

In addition, an outer extending flange 447 is formed at the outer periphery of the second end of the adjusting sleeve 441 that is opposite to the first end, while a stopping step 436 is formed in the bore of the mounting disc 43. When the adjusting sleeve 441 moves in a direction towards the switching valve 42, the outer extending flange 447 can drop into the stopping step 436, such that they can cooperate to delimit the end point of the movement of the adjusting sleeve 441 in such direction.

It is understood by the skilled person in the art that although a specific axial stopping structure between the adjusting sleeve 441 and the mounting disc is illustrated herein, this does not mean a limitation to the present disclosure, and other axial stopping structures are conceivable to be combined with the adjusting sleeve 441 and the mounting disc so as to obtain the transferring and adjusting mechanism of the disclosure.

Furthermore, in order to prevent the rotation of the adjusting sleeve 441 during the axial movement, a rotation preventing structure may also be formed between the adjusting sleeve 441 and the bore 431 of the mounting disc 43. For example, an axial groove and an axial protrusion, which are shape matched with each other, are formed between the adjusting sleeve 441 and the mounting disc 43.

In terms of the adjusting sleeve 441 and the adjusting stem 442 that are threadedly engaged with each other as shown in the drawings, it is desired that movement synchronization is ensured between the adjusting sleeve 441 and the adjusting stem 442 when moving away from the switching valve 42. That is, it is not desired that the adjusting stem 442 accidentally retracts in relative to the adjusting sleeve 441. However, after suffering multiple pressings, it may occur that the adjusting stem 442 gradually retracts into the adjusting sleeve 441. To avoid this, also provided between the adjusting sleeve 441 and the adjusting stem 442 is a retraction stopping member 444 which ensures that the adjusting stem 442 can be kept in proper position and will not retract into the adjusting sleeve 441 even after multiple pressings, by means of increasing the resistant force between the adjusting sleeve 441 and the adjusting stem 442. The retraction stopping member 444 may for example be a ring that is sleeved over the adjusting stem 442 and is abutted between the adjusting stem 442 and the adjusting sleeve 441.

Hereinafter, the principle of the mounting of the first and second assemblies will be described in combination with FIGS. 16-19.

Figure 12:
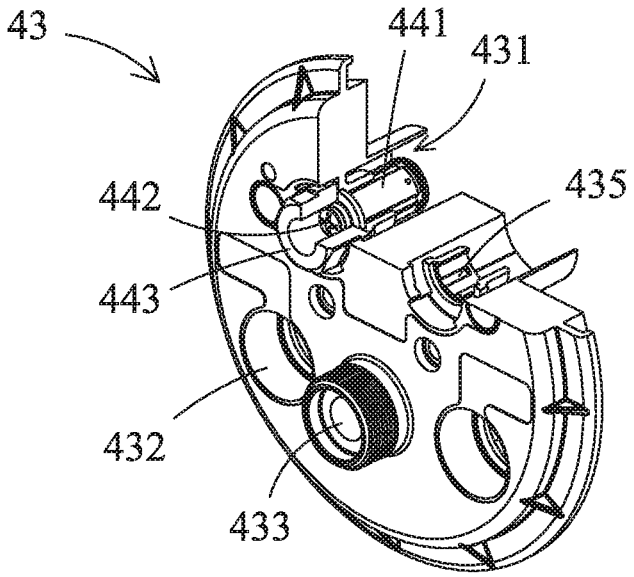
FIG. 12 is a partially sectioned view of the second preassembly according to an embodiment of the disclosure, wherein the adjusting stem does not extend from the adjusting sleeve.
Figure 13:
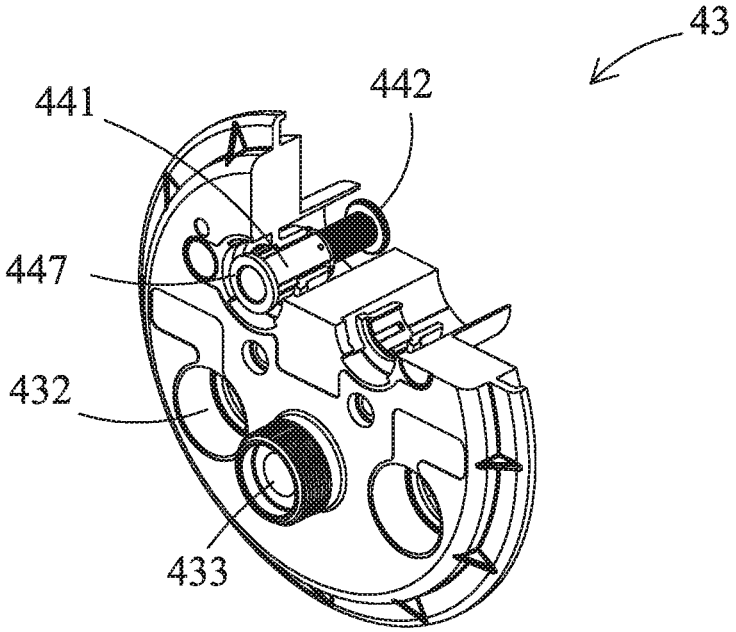
FIG. 13 is a partially sectioned view of the second preassembly according to an embodiment of the disclosure, wherein the adjusting stem extends from the adjusting sleeve.
Figure 16:
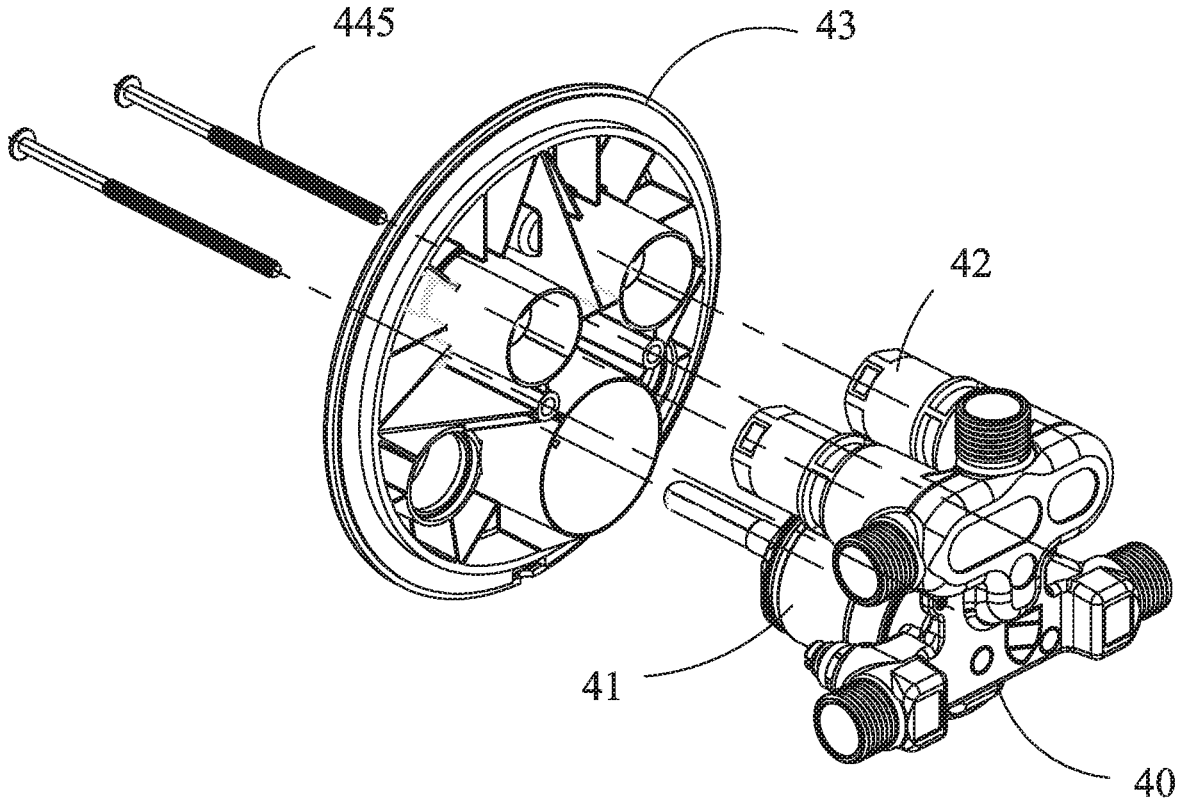
FIG. 16 is a schematic view of the first preassembly before engaging with the second preassembly according to an embodiment of the disclosure.
Figure 17:
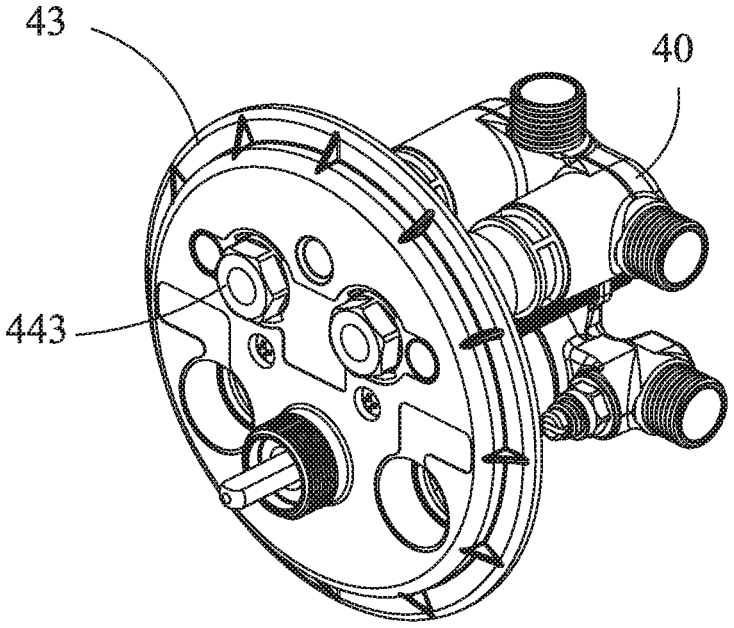
FIG. 17 is a schematic view of the first preassembly after engaging with the second preassembly according to an embodiment of the disclosure.
Figure 18:
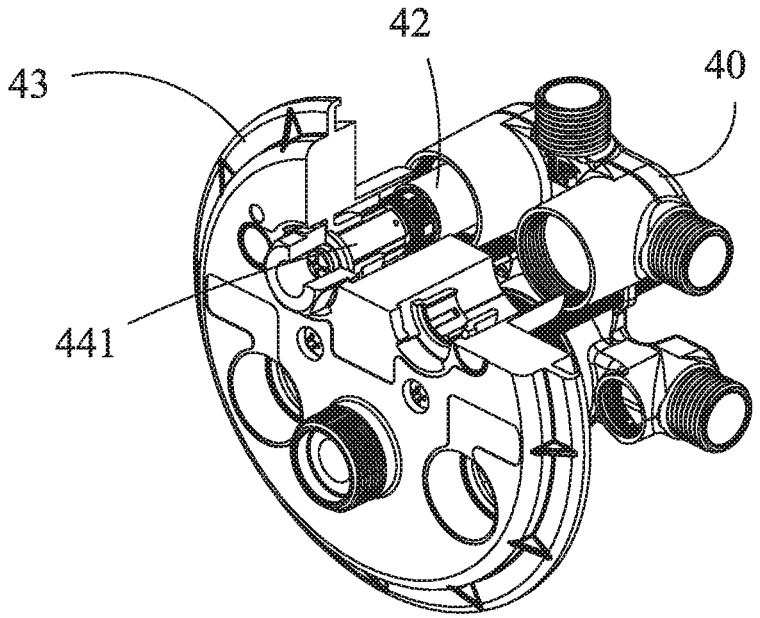
FIG. 18 is a schematic view of the second preassembly after engaging with the first preassembly according to an embodiment of the disclosure, wherein the mounting disc is partially cut, only one switching is shown and the adjusting stem does not extend from the adjusting sleeve.
Figure 19:
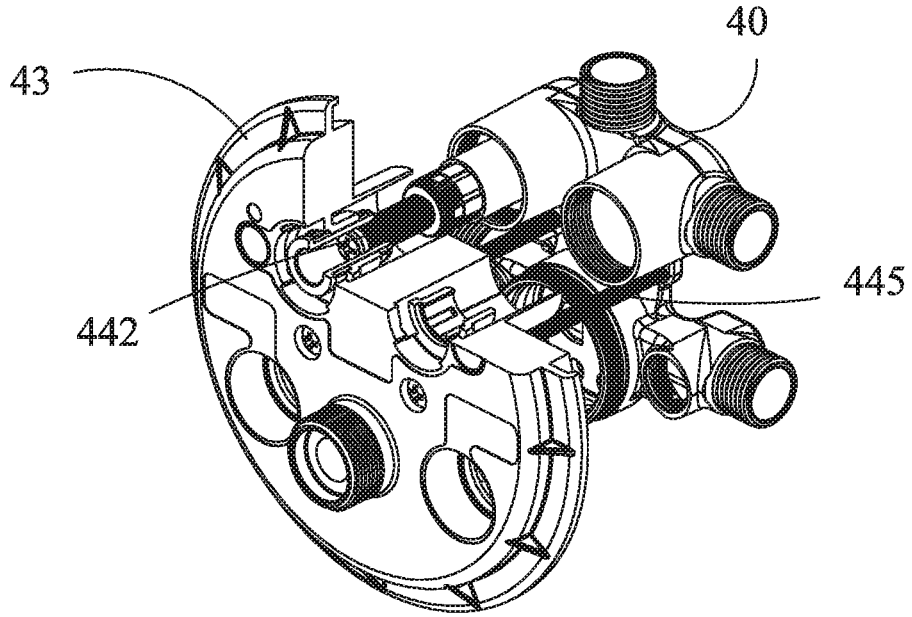
FIG. 19 is a schematic view of the second preassembly after engaging with the first preassembly according to an embodiment of the disclosure, wherein the mounting disc is partially cut, only one switching is shown and the adjusting stem extends from the adjusting sleeve.
Figure 20:
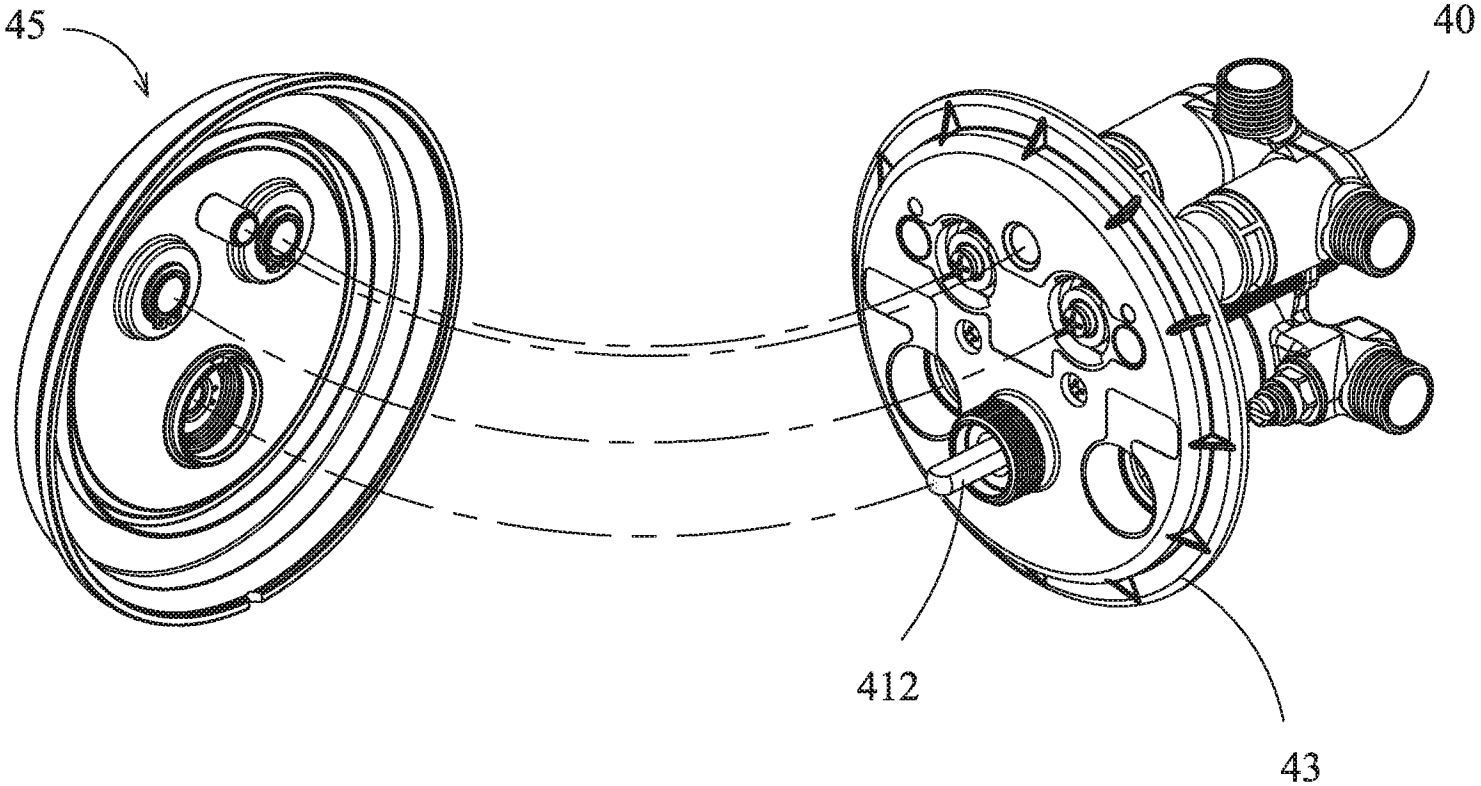
FIG. 20 is a schematic view of the third preassembly before engaging with the second preassembly according to an embodiment of the disclosure, wherein the mating relationship among the various parts is shown with dash dotted line.
Figure 21:
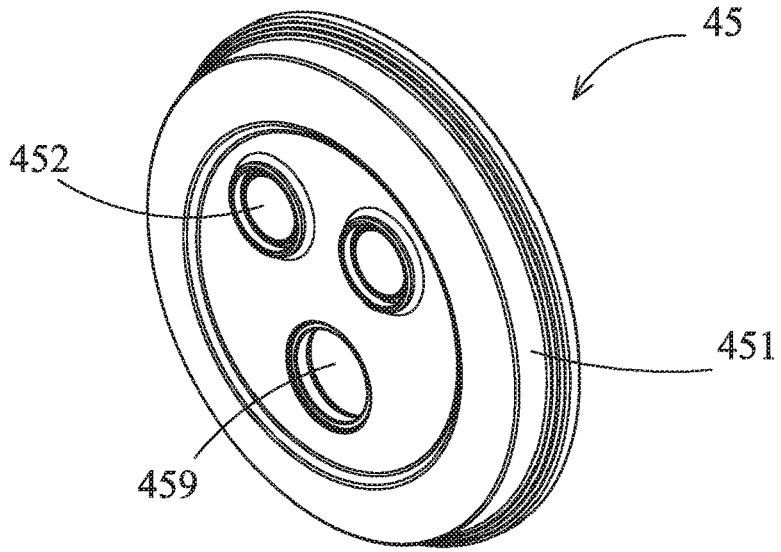
FIG. 21 is a schematic view of the panel member according to an embodiment of the disclosure.
Figure 22:
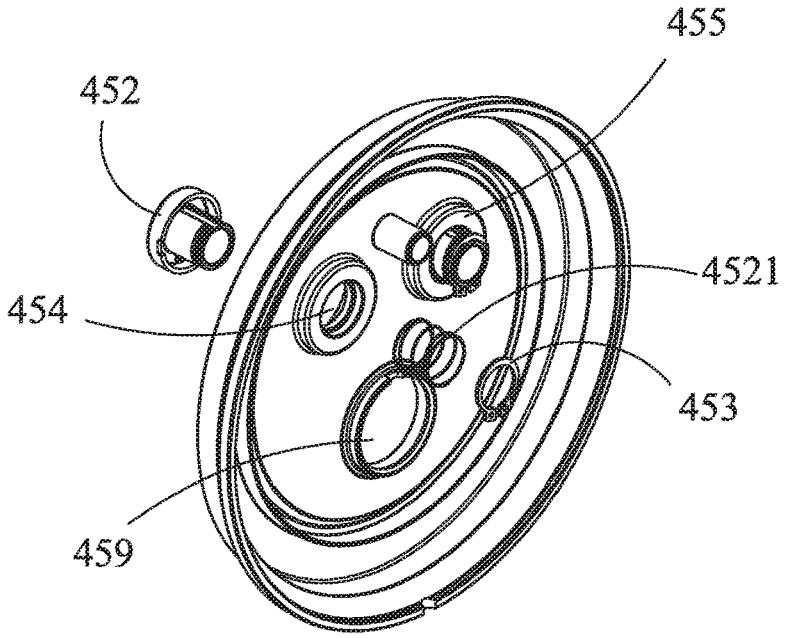
FIG. 22 is an exploded schematic view of the panel member according to an embodiment of the disclosure.
Figure 23:
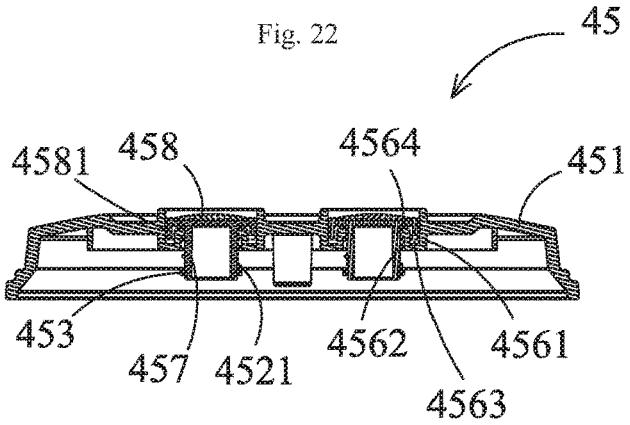
FIG. 23 is a sectioned view of the panel member according to an embodiment of the disclosure.
Figure 24:
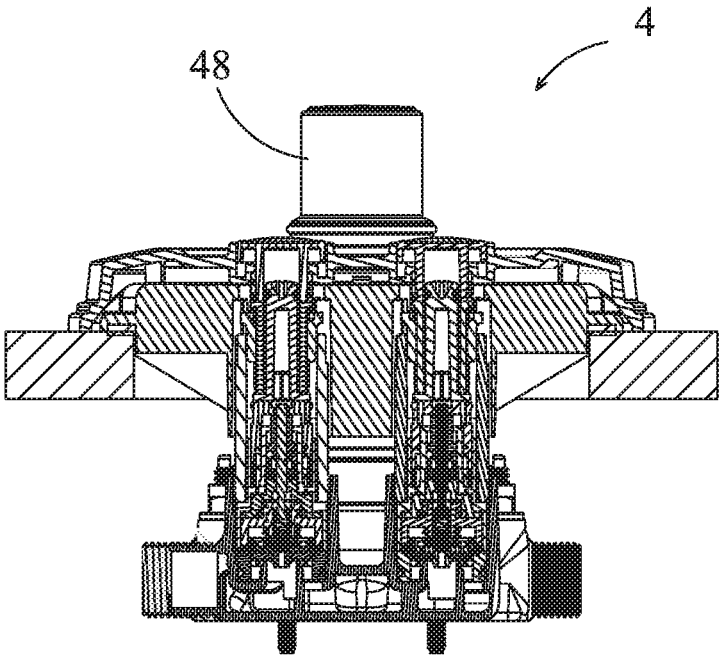
FIG. 24 is a sectioned view of the switching valve of the shower controlling device in the shallowest mounting state according to an embodiment of the disclosure.
Figure 25:
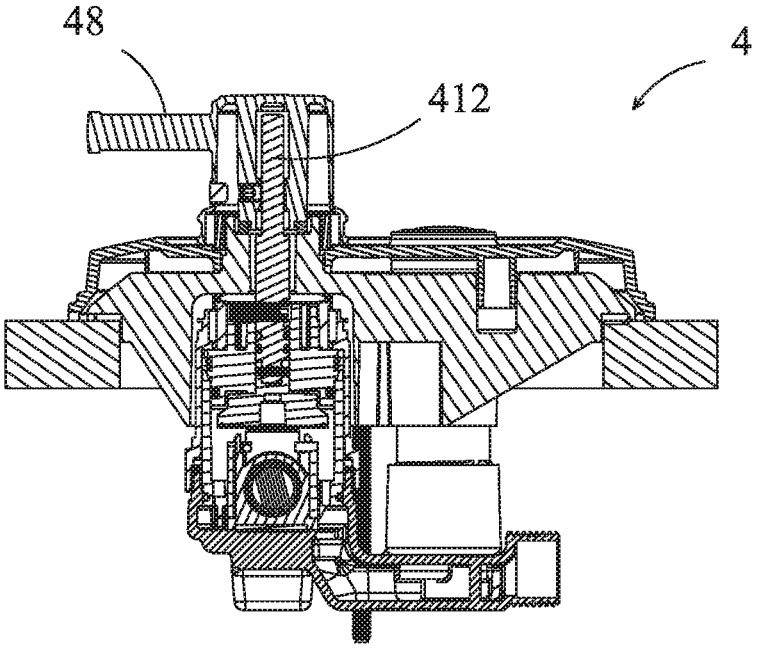
FIG. 25 is a sectioned view of the mixing valve of the shower controlling device in the shallowest mounting state according to an embodiment of the disclosure.
Figure 26:
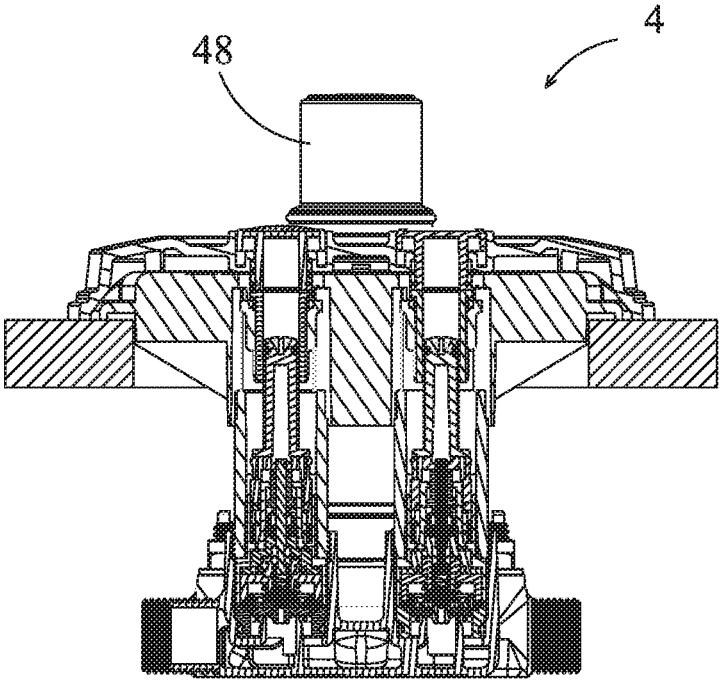
FIG. 26 is a sectioned view of the switching valve of the shower controlling device in the deepest mounting state according to an embodiment of the disclosure.
Figure 27:
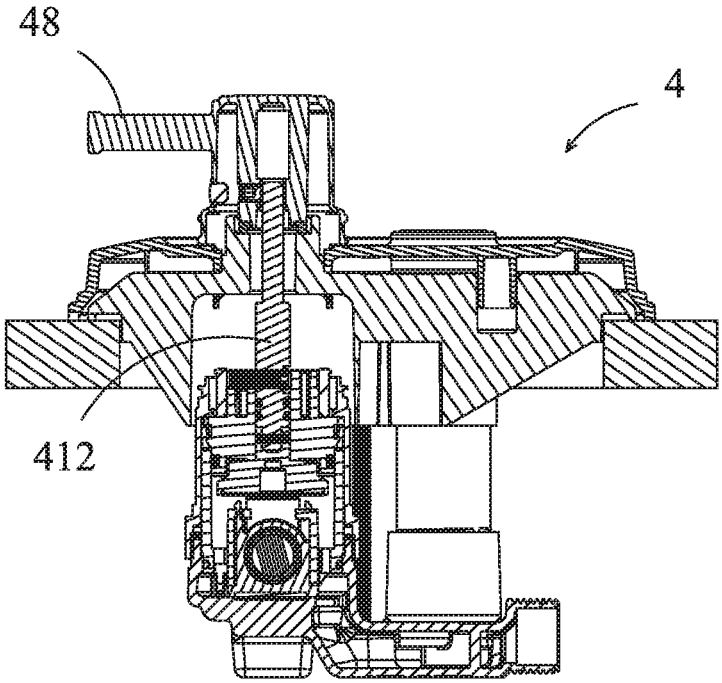
FIG. 27 is a sectioned view of the mixing valve of the shower controlling device in the deepest mounting state according to an embodiment of the disclosure.

Referring to FIGS. 16 and 18, the mounting disc 43 is mounted on the tube structure 40 by means of a screw 445. The screw 445 is adjusted according to the wall mounting depth, until the distance between the mounting disc 43 and the tube structure 40 becomes desired. Then, the transferring and adjusting mechanism 44 is substantially in the initial state as shown in FIG. 12, and the adjusting stem 442 fully retract in the adjusting sleeve 441. If the distance between the mounting disc 43 and the tube structure 40 is relatively short, as shown in FIG. 18, the adjusting stem 442 does not need to extend from the adjusting sleeve 441, in order to abut against the switching valve 42 and push the spring spool 421 to an extreme position. If the distance between the mounting disc 43 and the tube structure 40 is relatively long, as shown in FIGS. 13 and 19, it is necessary to twist the adjusting stem 442 to extend it from the adjusting sleeve 441, in order to extend the whole length of the transferring and adjusting mechanism 44 to contact the switching valve 42 and push the spring spool 421 to the extreme position.

Figure 14:
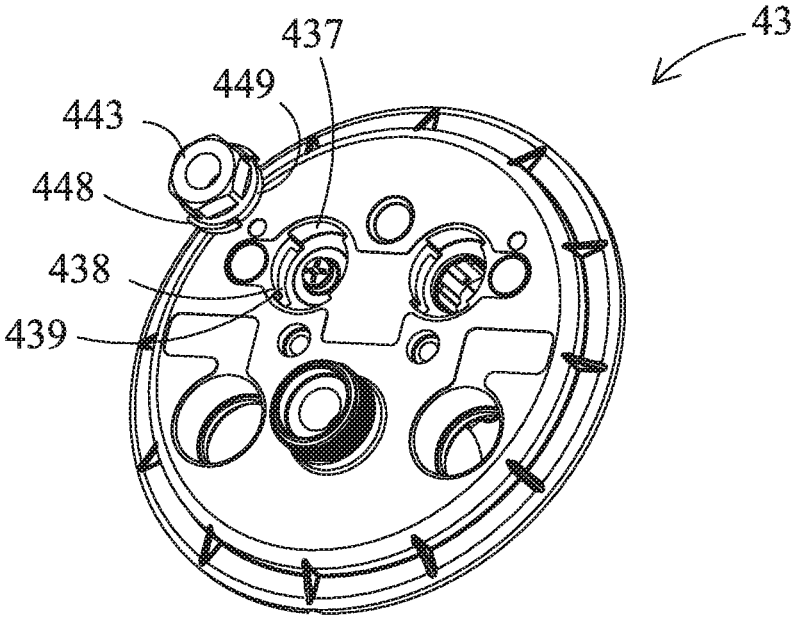
FIG. 14 is a schematic view of a limiter fitted with the bore of the mounting disc according to one embodiment of the disclosure.

During the pushing of the spring spool 421, it may happen that the external force exerted on the adjusting stem 442 disappears before the spring spool 421 come to the extreme position. In this case, the spring spool 421 may rebound and strike the transferring and adjusting mechanism 44, and thus the accuracy of the mounting may be adversely affected. In order to avoid this, a limiter 443 is provided in the bore 431 of the mounting disc 43 to limit the reverse movement of the adjusting sleeve 441 together with the adjusting stem. As shown in FIG. 14, in the shown embodiment, the limiter 443 includes a first protrusion 448 and a first recess 449 that are peripherally adjacent to each other, and the bore 431 of the mounting disc 43 includes a second recess 437 corresponding to the first protrusion 447 and a second protrusion 438 corresponding to the first recess 449. On the second protrusion 438 is formed a peripheral sliding groove 439 in which the first protrusion 448 slides and which is open at one end and closed at the other. During mounting, the first protrusion 448 is aligned with the second recess 437 and the first recess 449 is aligned with the second protrusion 438, such that the limiter 443 can be pressed into the bore 431. Then, the limiter 443 is rotated so that the first protrusion 448 moves into the peripheral sliding groove 439 through the open end, until this movement is stopped by the closed end. As such, the limiter 443 is fixed in the bore 431, and abuts against the adjusting sleeve 441 to prevent it from accident removal.

When it is ensured that the spring spool 421 of the switching valve 42 is pressed to the extreme position, the limiter 443 is detached and the external force exerted on the adjusting stem 442 is removed, so that the spring spool 421 slightly rebounds and pushes the adjusting stem 442 together with the adjusting sleeve 441 to fulfill a reverse movement. Since the small protrusion 446 on the adjusting sleeve 441 is stopped by the stopping end surface 4311, the adjusting sleeve 441 and the adjusting stem 442 cannot further move away from the switching valve 42. In this way, the adjustment between the transferring and adjusting mechanism 44 and the switching valve 42 is accomplished.

In order to prevent the detached limiter 443 from being arbitrarily discarded, two blind holes 432 are provided on the mounting disc 43 to store the detached limiter 443.

Figure 15:
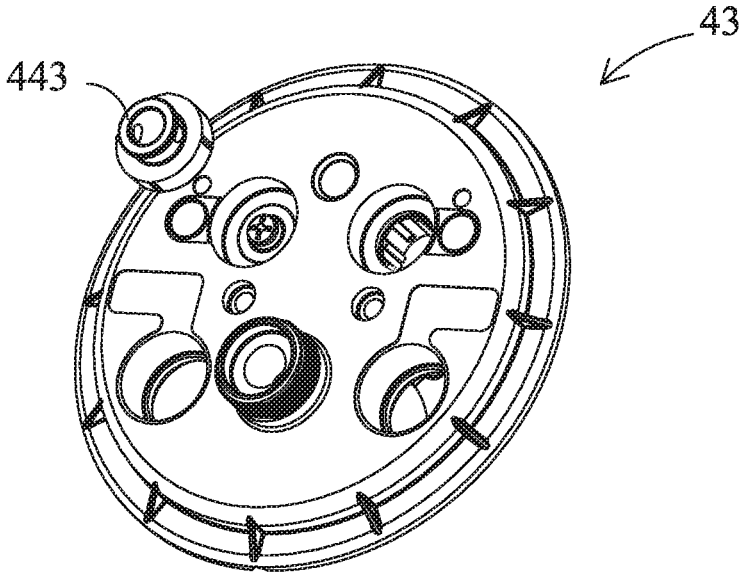
FIG. 15 is a schematic view of a limiter fitted with the bore of the mounting disc according to another embodiment of the disclosure.

Besides the configurations as shown in the drawings, the limiter 443 may be formed with other configurations, as long as the limiter can be fixed in relation to the mounting disc 43 to temporally stop the movement of the adjusting sleeve 441. For example, in another embodiment as shown in FIG. 15, an interference fit is formed between the limiter 443 and the bore 431 of the mounting disc 43.

FIGS. 20-27 show the schematic view of the mounting of the third preassembly to the second preassembly according to an embodiment of the present disclosure. As shown in FIGS. 20-23, the third preassembly comprises a panel member 45, which comprises a body 451 and two buttons 452 and springs 4521 provided on the body 451. The body 451 includes a first hole 454, a second hole 455 for accommodating the two buttons 452 and a third hole 459 through which the valve spindle 412 of the mixing valve 41 passes. As better shown in FIG. 23, the first hole 454 and second hole 455 of the body 451 are each defined by an annular wall 456. The annular wall 456 comprises an inner peripheral wall 4562, an outer peripheral wall 4561 and an annular groove 4563 formed between them, and the inner peripheral wall 4562 tapers in relation to the outer peripheral wall 4561. The button 452 comprises a cylinder portion 457 which is provided through the inner peripheral wall 4562 and a cover portion 458 which includes an overhanging section 4581 extending into the annular groove 4563. A snap ring 453 is fixed on the cylinder portion 457 of the button 452. The spring 4521 is pressed between the snap ring 453 and the inner extending flange 4564 of the inner peripheral wall 4562 and exerts a pushing force to the button 452 in the direction of the transferring and adjusting mechanism 44. The button 452 always moves synchronously with the transferring and adjusting mechanism 44 under the effect of the spring force, and the switching on/off of the switching valve 42 can be visually determined.

Turning back to FIGS. 2-4, after the assembling of the first, second and third preassemblies, the screw nut 434 is screwed on the outer threaded section of the aperture 433 of the mounting disc 43 to fix the panel member 45. Then, the shim 481 is mounted and the handle 48 is connected to the valve spindle 412 of the mixing valve 41. Now the mounting of the shower controlling device 4 is completed. As shown in FIG. 3, the shim 481 is a non-closed ring, and can overcome the manufacturing tolerance between the shim 481 and the handle 48 or the valve spindle 412 to ensure the coaxiality. Further referring to FIGS. 24 and 25, when the mounting depth in the wall is relatively shallow, the transferring and adjusting mechanism does not need to extend, so that the shower controlling device is configured as the mounting state as shown in these figures. Further referring to FIGS. 26 and 27, when the mounting depth in the wall is relatively deep, the transferring and adjusting mechanism extend from the adjusting sleeve, so that the shower controlling device is configured as the mounting state as shown in these figures.

It is understood that although the present disclosure describes according to individual embodiments, this does not mean that each embodiment comprises only one independent technical solution, and such description of the present disclosure is only for the sake of clarity. The skilled person in the art shall take the present disclosure as a whole, and the technical solutions in the various embodiments can be combined in suitable ways to form other embodiments that can be understood by the skilled person in the art.

The above is only a schematic description of the specific embodiments of the present disclosure, and is not intended to be a limitation to the scope of the disclosure. All the equivalent changes, modifications and combinations made by any skilled person in the art without departing the concept and principle of the present disclosure fall into the scope of protection of the disclosure.

What is claimed is:

1. A shower controlling device, comprising:

a tube structure comprising a first inlet tube, a second inlet tube and an outlet tube;

a mixing valve comprising a mixing chamber that is in fluid communication with the outlet tube and is maintained to be in fluid communication with at least one of the first inlet tube and the second inlet tube;

a switching valve that is spaced apart from the mixing valve and is suitable for controlling the switching on/off of the outlet tube;

a mounting disc that is provided to be spaced apart from the tube structure; and a transferring and adjusting mechanism that is mounted between the switching valve and the mounting disc in such a manner that the length of the mechanism is adjustable, and allows for operating the switching valve under an external force, wherein the transferring and adjusting mechanism comprises:

an adjusting sleeve that is axially movably supported on the mounting disc; and an adjusting stem that is axially movably provided in the adjusting sleeve and adapted to press the switching valve, wherein the adjusting stem is configured to move away from the switching valve together with the adjusting sleeve after the disappearance of the external force.

2. The shower controlling device according to the claim 1, further comprising a panel member comprising:

a body for covering the mounting disc;

a button that is accommodated within a hole of the body and abutted against the transferring and adjusting mechanism; and a spring that is provided between the body and the button and configured to exert a force to the button towards the transferring and adjusting mechanism.

3. The shower controlling device according to the claim 2, wherein the tube structure, the mixing valve and the switching valve constitute a first preassembly, wherein the mounting disc and the transferring and adjusting mechanism constitute a second preassembly, and wherein the panel member constitutes a third preassembly.

4. The shower controlling device according to the claim 1, wherein the transferring and adjusting mechanism is configured to allow for pressing the switching valve to an extreme state under the external force.

5. The shower controlling device according to the claim 1, wherein the mounting disc comprises a bore for accommodating the transferring and adjusting mechanism, and between at least one of the two ends of the adjusting sleeve and the bore is formed an axial stopping structure defining a terminal of the axial movement of the adjusting sleeve.

6. The shower controlling device according to the claim 5, wherein the axial stopping structure comprises:

a small protrusion formed on the outer peripheral surface of the adjusting sleeve; and a stopping end surface formed on the bore of the mounting disc.

7. The shower controlling device according to the claim 6, wherein the bore forms an axial groove bypassing the small protrusion and spaced apart from the stopping end surface.

8. The shower controlling device according to the claim 5, wherein the axial stopping structure comprises:

an outer extending flange formed on the adjusting sleeve; and a stopping step formed on the bore, wherein the outer extending flange resides on the stopping step.

9. The shower controlling device according to the claim 1, further comprising a limiter that is detachably coupled to the mounting disc to limit movement of the transferring and adjusting mechanism away from the switching valve.

10. The shower controlling device according to the claim 9, wherein the limiter comprises a first protrusion and a first recess that are peripherally adjacent to each other, the bore of the mounting disc accommodating the transferring and adjusting mechanism comprises a second recess corresponding to the first protrusion and a second protrusion corresponding to the first recess, and wherein on the second protrusion is formed a peripheral sliding groove in which the first protrusion slides and which comprises an open end and a closed end; or the dimensions of the limiter is configured to form an interference fit with the bore of the mounting disc.

11. A shower device, comprising:

a shower controlling device according to claim 1; and a sprayer in fluid communication with the outlet tube of the tube structure of the shower controlling device.

* * * * *